US006140641A

United States Patent [19]

Yoshinari et al.

[11] Patent Number: 6,140,641

[45] Date of Patent: Oct. 31, 2000

[54] ION-TRAP MASS ANALYZING APPARATUS AND ION TRAP MASS ANALYZING METHOD

[75] Inventors: Kiyomi Yoshinari, Hitachi; Yoichi Ose; Yoshiaki Kato, both of Mito; Katsuhiro Nakagawa, Hitachiohta, all of Japan

[73] Assignee: Hitachi, Ltd., Tokyo, Japan

[21] Appl. No.: 09/089,088

[22] Filed: Jun. 2, 1998

[30] Foreign Application Priority Data

Jun. 10, 1997 [JP] Japan ..... 9-151874

[51] Int. Cl.[7] ..... H01J 49/00

[52] U.S. Cl. ..... 250/292; 250/281; 250/282

[58] Field of Search ..... 250/292, 281, 250/282, 290

[56] References Cited

U.S. PATENT DOCUMENTS 5,572,025 11/1996 Cotter et al. ..... 250/292

5,610,397 3/1997 Kelley ..... 250/292

*Primary Examiner*—Kiet T. Nguyen

*Attorney, Agent, or Firm*—Kenyon & Kenyon

[57] ABSTRACT

An numerical analysis time which is assigned to mass select one ion species having a specific mass-to-charge ratio mass selected is divided into the first part time and the second part time, and a dipole auxiliary electric field capable of spatially reducing a spread is superimposed in the first part time of the numerical analysis time and a quadrupole auxiliary voltage capable of rapidly emitting ions when position coordinates are large is superimposed in the second part of the time. Therefore, the initial spatial spread is reduced in the first part time and the trajectories of ions is rapidly amplified in the second part time, and the ions are emitted. Thus, the entire mass sweep time can be reduced and a high-resolution numerical analysis can be accelerated.

13 Claims, 15 Drawing Sheets

ION-TRAP MASS ANALYZING APPARATUS AND ION TRAP MASS ANALYZING METHOD

BACKGROUND OF THE INVENTION

The present invention relates to an ion-trap mass analyzing apparatus and its analyzing method, particularly to an ion-trap mass analyzing apparatus and its analyzing method preferred to analyze the mass of an ion at a high velocity and a high resolution.

An ion trap mass analyzing apparatus is an apparatus for analyzing the mass by trapping ions in a trap field, ejecting the trapped ions from the trap field by various methods, and detecting the ions. Because the ion-trap mass analyzing apparatus traps and detects ions, it realizes a high-sensitivity numerical analysis and, therefore, it has been widely developed in recent years. To eject ions from an ion trap field, it is general to use the so-called auxiliary electric field. Energy is supplied to ions by the auxiliary electric field to increase the amplitude of the ions, thereby ejecting the ions from the trap field. Many types of auxiliary electric fields are also proposed. For example, a dipole auxiliary AC electric field and a quadrupole auxiliary AC electric field are listed.

A dipole auxiliary electric field provides an electric field almost not depending on the position coordinates of an ion as disclosed in the official gazette of Japanese Patent Laid-Open No. 103856/1990. Therefore, when the amplitude and the velocity of an ion oscillation increase, the resistance force to ions due to collision with batter gas increases by a value equivalent to the increase of the amplitude and the velocity, and spatial dispersion between ions contracts. Thus, because the auxiliary electric field has a function of decreasing degree of dispersion in the position coordinates, the ejection time difference of ions decreases and the resolution is improved. However, because the amplitude of ion oscillation increase with the constant velocity, the auxiliary field has also disadvantages that emission of ions requires a lot of time and the scanning rate of mass numerical analysis cannot be increased.

However, the quadrupole auxiliary AC electric field supplies an electric field depending on the position coordinates of an ion as disclosed in U.S. Pat. No. 3065640. Therefore, when the amplitude and the velocity of an ion oscillation increase, the increasing amount of amplitude of ion oscillation further increases by a value equivalent to the increase of the amplitude of the ion is oscillation. Therefore, as the amplitude of the ion oscillation increases, the increasing amount of amplitude increases, ions are more quickly emitted, thereby accelerating the scanning of mass numerical analysis. However, because the electric field depends on the position coordinates of an ion, the difference of the ejection time of each ion increases.

SUMMARY OF THE INVENTION

It is an object of the present invention to provide an ion-trap mass analyzing apparatus (and its analyzing method) capable of solving the above problems, increasing the scanning rate of mass numerical analysis, and improving the resolution.

To achieve the above objects, the present invention is constituted so as to capture ions in a trap space by applying an AC voltage to an electrode, forming first and second electric fields for increasing the amplitude of the captured ions by supplying energy to them, and form the second electric field after forming the first electric field which has less influence of the amplitude of an ion to the position of the ion than the second electric field does.

Moreover preferably, in the case of an ion-trap mass analyzing method having an annular ring electrode and two end cap electrodes faced each other so as to hold the annular electrode and detecting ions by amplifying ion oscillation, having a mass-to-charge ratio to be selected by generating a weak auxiliary AC electric field compared to the quadrupole electric field among ions stably captured in a quadrupole electric field formed in an inter-electrode space by applying at least a high-frequency voltage of a DC voltage and the high-frequency voltage between the ring electrode and the end cap electrode from the main power supply and emitting the ions from the inter-electrode space, a dipole auxiliary electric field and a quadrupole auxiliary electric field are temporally alternately generated by applying AC voltages half-phase shifted from each other (out-of-phase) to two end cap electrodes and by applying AC voltages having the same phase to two end cap electrodes or applying an auxiliary AC voltage to the ring electrode within a predetermined period.

DETAILED DESCRIPTION

Embodiments of the present invention are described below by referring to the accompanying drawings. First, to make the present invention easily understood, a dipole auxiliary AC electric field and a quadrupole auxiliary AC electric field are respectively described and, thereafter, characteristic portions are described.

Figure 2:
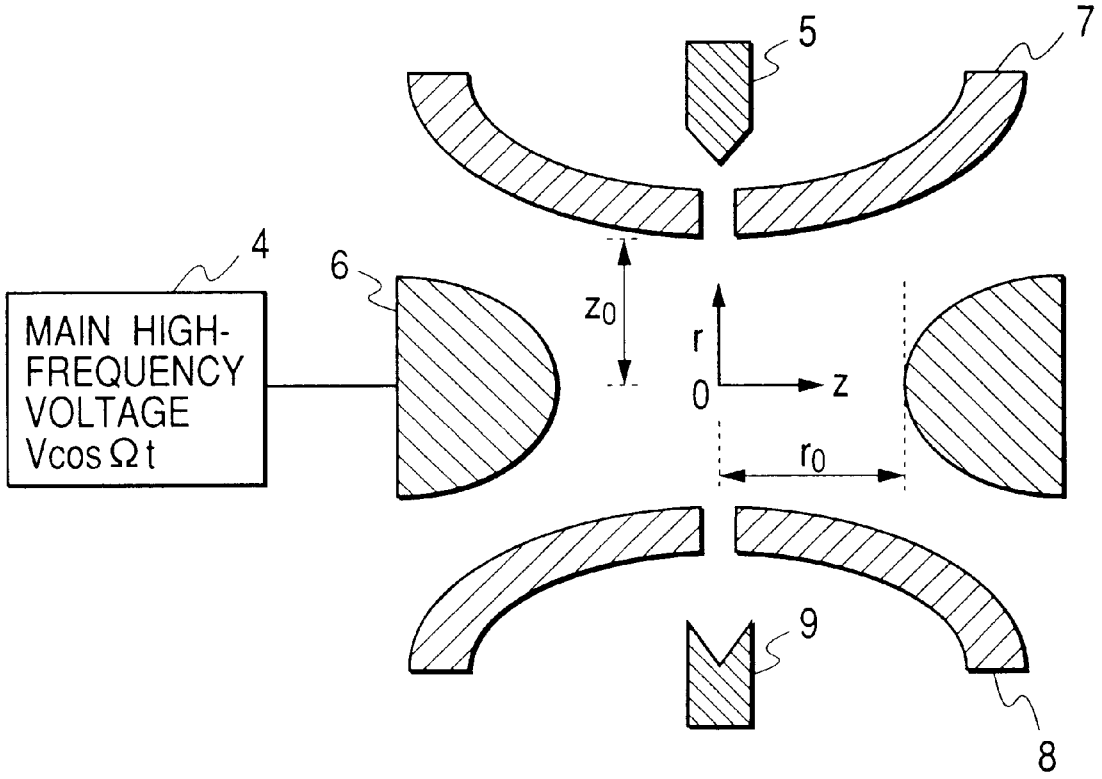
FIG. 2 is a sectional view of each electrode of an ion trap.

As shown in FIG. 2, an ion-trap mass analyzing apparatus is constituted with two end cap electrodes arranged in opposite direction and a ring electrode intervening in the end cap electrodes. A DC voltage U and a high-frequency voltage V cos Ω are applied between the end cap electrodes and accordingly, a quadrupole electric field is formed in the gap between the electrodes. The stability of the trajectory of an ion captured into the electric field is determined by values a and q provided by the size (inner radius $r_o$ of ring-electrode) of an apparatus, the amplitude of a DC voltage U, the amplitude V of a high-frequency voltage and its angular frequency Ω, and the mass-to-charge ratio m/Z of an ion {expression (1)}.

[Numerical formula 1]

$$a = \frac{8eU}{r_0^2\Psi^2}\cdot\frac{z}{m},\quad q = \frac{4eV}{r_0^2\Psi^2}\cdot\frac{z}{m} \tag{1}$$

Figure 3:
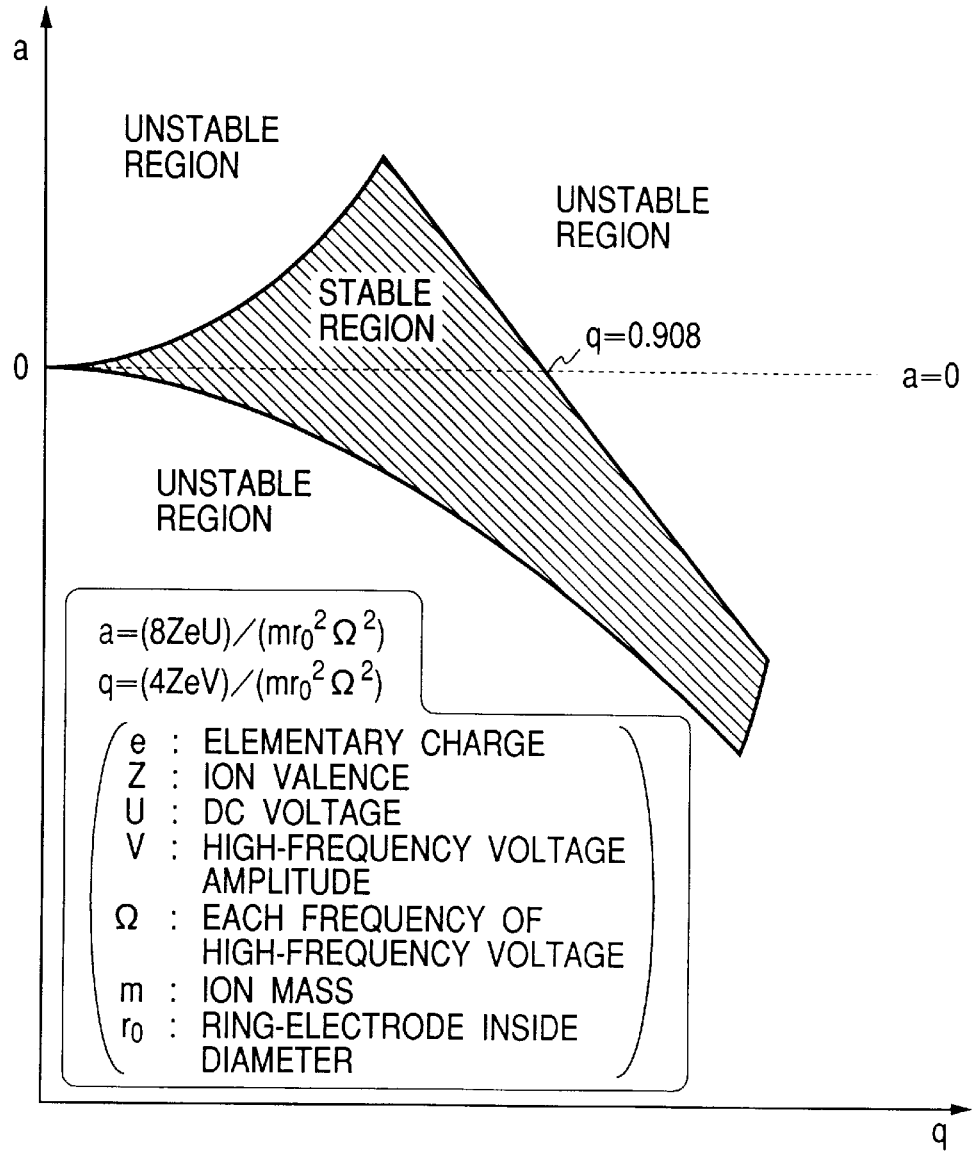
FIG. 3 is a stable region diagram of values a and q for determining the stability of an ion trajectory in an ion trap.

In the above expression, z denotes the number of charges of ions, m denotes mass, and e denotes an elementary charge. FIG. 3 shows a stable region showing the ranges of a and q for providing a stable trajectory in the space between ion-trap electrodes. Every ion present in the stable region stably oscillates in the inter-electrode space. In this case, ions oscillate at different frequencies correspondingly to the mass-to-charge ratio m/Z. Normally, by using this point, an auxiliary AC electric field at a specific frequency is generated in the space between electrode trajectories of only ions resonating with the auxiliary AC electric field are amplified and emitted from the trapping space. The mass-to-charge ratio m/Z of the ions whose mass should be analyzed is swept within a certain range to measure the mass distribution of a substance constituting a sample. In this case, the auxiliary AC electric field generated in the inter-electrode space is roughly divided into the following two types: a dipole auxiliary AC electric field and a quadrupole auxiliary AC electric field. The dipole auxiliary AC electric field is generated by applying AC voltages shifted by part phase each other to two end cap electrodes respectively. The quadrupole auxiliary AC electric field is generated by applying AC voltages of the same phase to two end cap electrodes respectively or an auxiliary AC voltage to a ring electrode. Then, the quadrupole auxiliary AC electric field is described below. While sweeping the mass-to-charge ratio m/Z of an ion to be mass-separated, only a dipole auxiliary AC electric field is generated to perform mass numerical analysis. In this case, the approximate expression of the magnitude $E_d$ in z direction (direction from the center of trap to end-cap) of a dipole auxiliary AC electric field under an ideal state in which voltages $V_d \cos \omega_d t$ shifted by part phase each other are applied to two end cap electrodes is shown by the following approximate expression (2).

[Numerical formula 2]

$$E_d = \frac{V_d}{z_0}\cos\omega_d t \quad (\text{whre}, \omega_d\text{: } 0 < \omega_d < \Psi/2) \tag{2}$$

Figure 4:
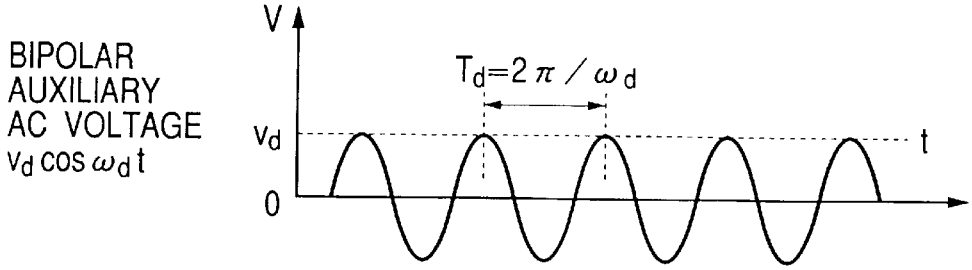
FIG. 4 is an auxiliary voltage waveform diagram to be applied to one end cap electrode in a dipole auxiliary AC voltage.
Figure 5:
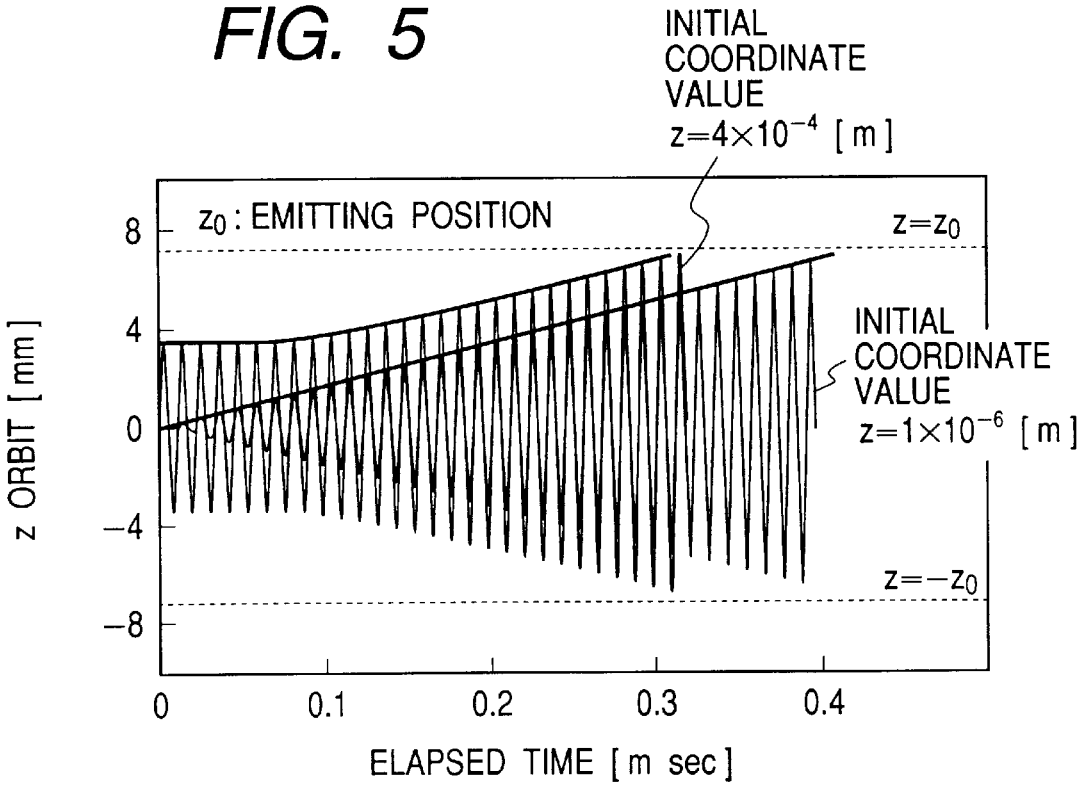
FIG. 5 is an illustration showing calculation results of two ion trajectories different from each other in initial coordinate value.
Figure 6:
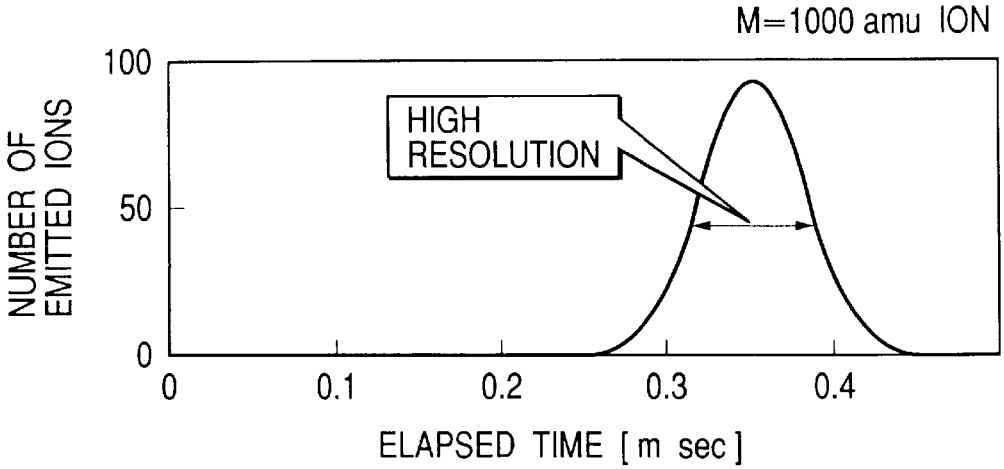
FIG. 6 is an illustration showing an calculation result of a mass spectrum when only a dipole auxiliary AC voltage is applied.
Figure 7:
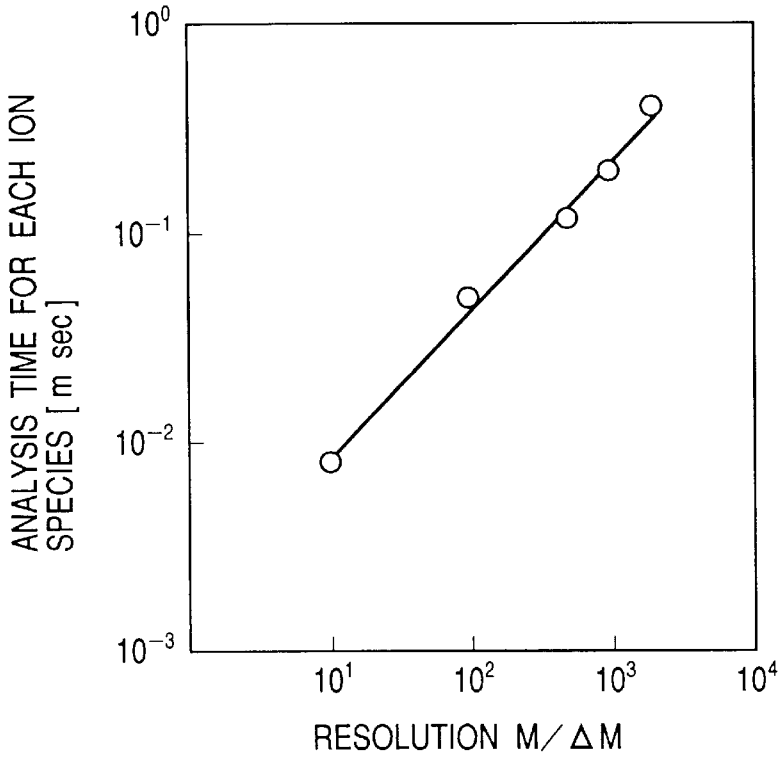
FIG. 7 is an illustration showing an calculation result of the relation between mass resolution and time required for an ion to be emitted from the space between electrodes when only a dipole auxiliary AC voltage is applied.
Figure 8:
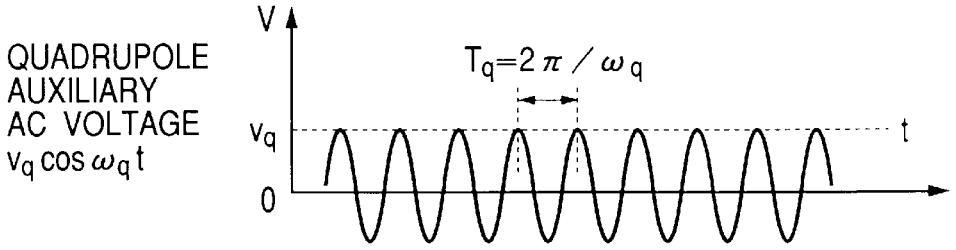
FIG. 8 is a waveform diagram of an auxiliary voltage to be applied to a ring electrode or two end cap electrodes at a quadrupole auxiliary AC voltage.

Because position coordinates z of an ion are not included in the above expression, it is found that a dipole auxiliary AC electric field hardly depends on the position of an ion. FIG. 4 shows the waveform of a dipole auxiliary AC electric field, FIGS. 5 and 6 show the trajectory of an ion resonated in the above case and the result of numerically analyzing a mass spectrum obtained in the above case, and FIG. 7 shows the relation between the mass resolution obtained as the result of an numerical analysis and the time required for the mass separation obtained through an numerical numerical analysis. FIG. 5 shows the trajectories of two ions of the initial coordinates of which are of $4\times10^{-4}$ [m] and $1\times10^{-6}$ [m]. Because an auxiliary electric field does not depend on the position of an ion, both trajectories are almost linearly amplified to time independently of the initial coordinate values. In this case, it is found that the difference between the first initial coordinate values is gradually decreased. It is estimated that the above mentioned is caused by the fact that the resistance force due to collision with neutral gas present in the space between ion-trap electrodes is proportional to the velocity of an ion motion. Ions having the same mass-to-charge ratio m/Z oscillates at the same frequency independently of initial coordinates. Therefore, it is estimated that an ion having large initial coordinate values has a high velocity because of having a large oscillation amplitude, receives a resistance value larger than that of an ion having small initial coordinate values, thereby decreasing the difference between position coordinates, that is, the spatial dispersion. Thus, when using a dipole auxiliary AC electric field, there is an advantage that the difference of position coordinates between ions is decreased. FIG. 6 shows the time distribution of 500 ions emitted through the hole of an end cap electrode by numerical analyzing the trajectories of the 500 ions different from each other in initial coordinate values similarly to the result in FIG. 5 when using a dipole auxiliary AC electric field. When actually operating an ion trap, the above emission time distribution diagram corresponds to a mass spectrum diagram because of sweeping the mass number in a certain mass range. From FIG. 6 it is found that the difference of the emission time distribution is small, and a high resolution calculation is obtained because the difference between position coordinates, that is, the spatial dispersion decreases. Because a dipole auxiliary AC electric field can be analyzed at a high resolution, a dipole resonant electric field has been used so far. From FIG. 7, however, it is found that the time required for a mass numerical analysis must be greatly increased in order to obtain a high resolution in the case of a dipole resonant electric field. In the case of a normal mass numerical analysis, the sweep rate of the mass-to-charge ratio m/z of an ion to be mass-separated is kept constant in order to simplify apparatuses and circuit processing. In this case, when a high resolution is required, it is necessary to increase the time assigned to one ionic species. That is, when generating a dipole auxiliary AC electric field, the entire mass sweep time is greatly increased in order to perform a high-resolution numerical analysis.

Moreover, a quadrupole auxiliary AC electric field is described below. The magnitude of z component (end-cap directional component) of a quadrupole auxiliary AC electric field Eq under an ideal state in which a voltage $V_q \cos \omega_q t$ is applied to a ring electrode or voltages $V_q \cos \omega_q t$ having the same phase are applied to two end cap electrodes has the relation of the following expression (3).

$$Eq = \frac{V_q}{Z_0^2} z \cos \omega_q t$$

(Where, $\omega_q$:$0<\omega_q<\Omega$, z:z coordinates of ion) (3)

Figure 9:
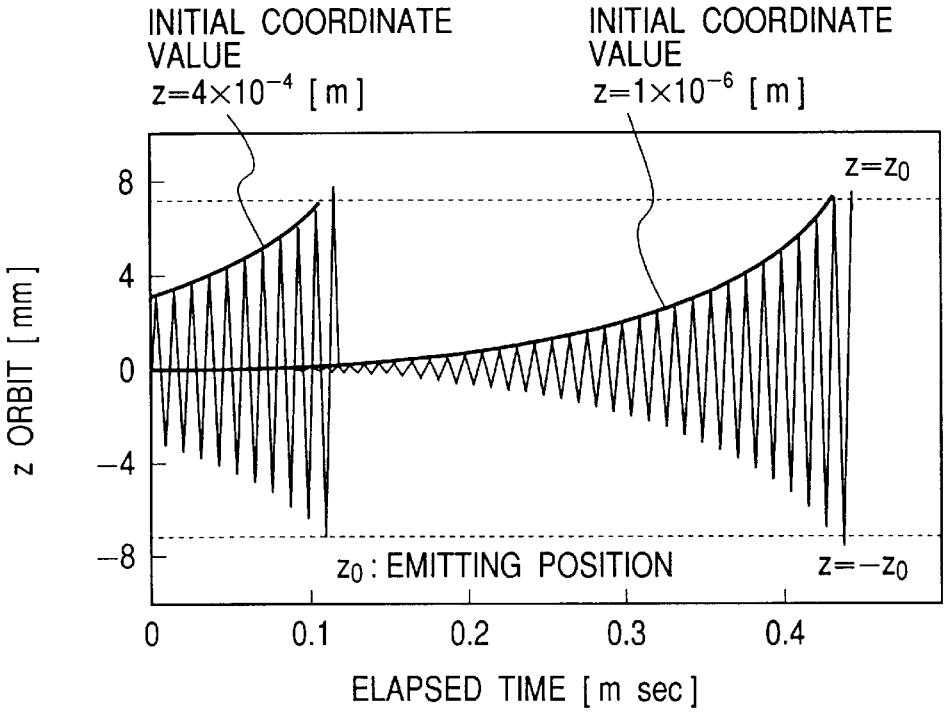
FIG. 9 is an illustration showing calculation results of two ion trajectories different from each other in initial coordinate value according to only a quadrupole auxiliary AC voltage.
Figure 10:
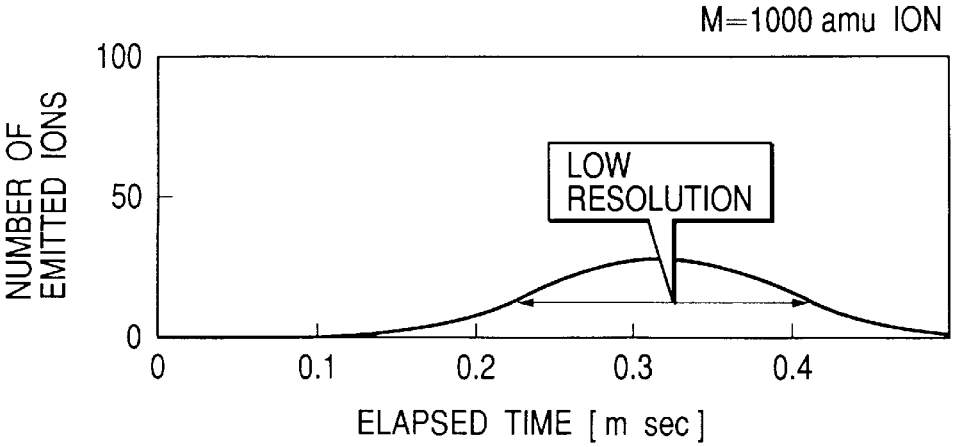
FIG. 10 is an illustration showing an calculation result of a mass spectrum according to only a quadrupole auxiliary AC voltage.
Figure 11:
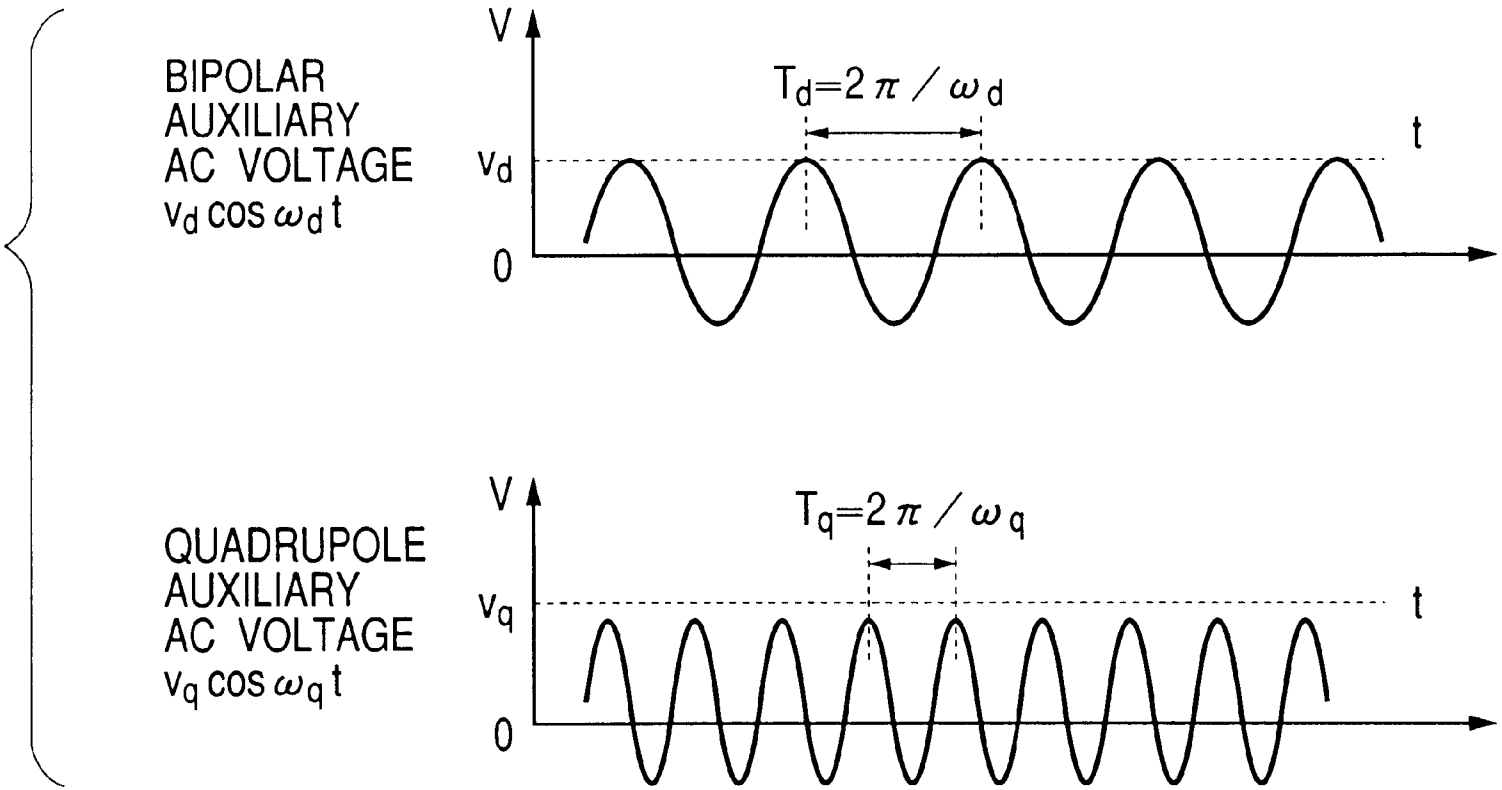
FIG. 11 is waveform diagrams of a dipole auxiliary AC voltage to be applied to an end cap electrode by shifting the voltage by a part phase and a quadrupole auxiliary AC voltage to be applied to two end cap electrodes or a ring electrode when using a dipole auxiliary AC voltage applying method and a quadrupole auxiliary AC voltage applying method together.
Figure 12:
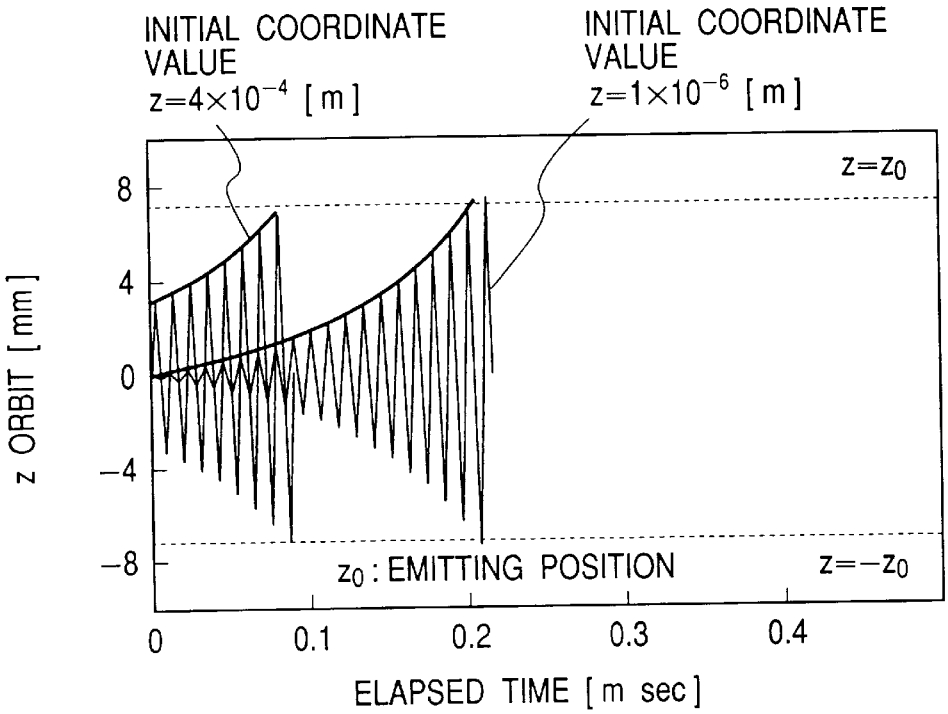
FIG. 12 is an illustration showing calculation results of two ion trajectories different from each other in initial coordinate value when using a dipole auxiliary AC voltage applying method and a quadrupole auxiliary AC voltage applying method together.
Figure 13:
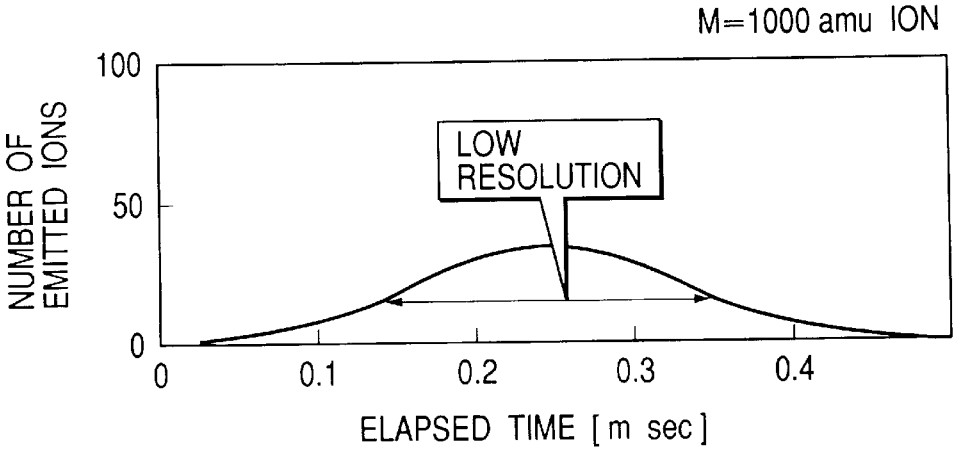
FIG. 13 is an illustration showing an calculation result of a mass spectrum when using a dipole auxiliary AC voltage applying method and a quadrupole auxiliary AC voltage applying method together.

Similarly to the case of FIGS. 4 to 6, FIG. 8 shows the waveform of the auxiliary AC voltage in the above case and FIGS. 9 and 10 show the results of numerically analyzing two ion trajectories different from each other in initial coordinate values and the mass spectrum obtained in the above case. In this case, because the magnitude of an auxiliary electric field depends on ion coordinate values, the auxiliary electric field becomes weak for an ion having small initial coordinate values, that is, an ion close to the center and, therefore, the resonance effect does not greatly work on the ion. For an ion having large initial coordinate values, that is, an ion far from the center, however, the auxiliary electric field becomes strong and the resonant effect increases. That is, it is found that an ion can be emitted from the inter-electrode space very rapidly when the ion has large position coordinate values but the time required for emission of an ion increases when the ion has small position coordinate values. Therefore, the difference of position coordinate values between ions increases as time passes. Thus, when generating only a quadrupole auxiliary AC electric field, only a low-resolution numerical analysis can be obtained. Therefore, the quadrupole auxiliary AC electric field has not frequently used so far. Moreover, a dipole auxiliary AC electric field and a quadrupole auxiliary AC electric field may be superimposed and applied to an electrode at the same time. FIG. 11 shows the waveform of an auxiliary AC voltage applied to the electrode in the above case, and FIGS. 12 and 13 show two ion trajectories different from each other in initial coordinate values and the result of numerically analyzing the mass spectrum obtained in the above case. Normally, the angular frequency of a quadrupole auxiliary AC electric field is set to a value approx. two times larger than that of the dipole type. In this case, the dispersion due to the repulsion between ions is slightly moderated compared to the case of applying only the quadrupole type. However, because a quadrupole auxiliary electric field is applied after application of an auxiliary AC electric field is started, the initial spatial dispersion tends to increase but the mass analysis time decreases compared to the case of applying only a dipole auxiliary electric field or a quadrupole auxiliary electric field.

In the case of a dipole auxiliary AC electric field applying method, it is necessary to greatly increase the entire mass sweep time in order to obtain a high-resolution mass spectrum. In this case, the time for obtaining one mass spectrum increases. And when trapping ions in an inter-electrode space for a long time, a secondary reaction occurs due to collision of the ions with neutral gas molecules present in the inter-electrode space or the ions are influenced by space charges due to other ions and the timing for emitting the ions from the inter-electrode space is shifted, that is, the positional displacement (mass shift) of the mass spectrum occurs and the numerical analysis accuracy may be deteriorated.

The quadrupole auxiliary AC electric field applying method is limited in high-resolution numerical analysis. Therefore, by further superimposing a dipole auxiliary electric field effective to reduce a spatial spread in the first half period which is assigned to select one ion species and a quadrupole auxiliary voltage capable of emitting ions at the second half period, it is possible to reduce the spatial dispersion in the first half period, emit ions in the second half period, and accelerate the mass-selective sweep while achieving a high-resolution numerical analysis.

Figure 1:
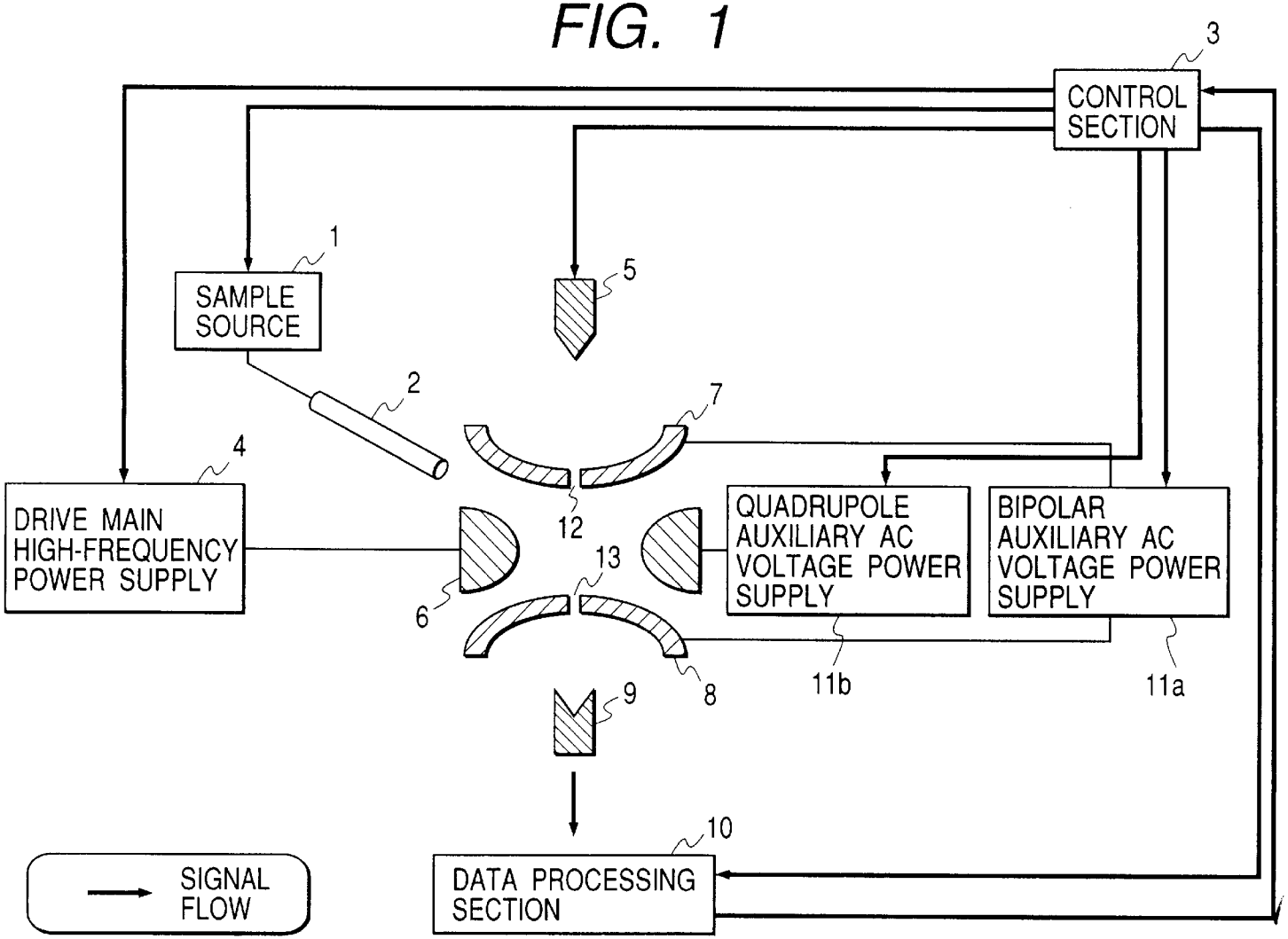
FIG. 1 is a schematic view of the whole of the ion-trap mass analyzing apparatus of the first embodiment.

Characteristic portions (first embodiment) are described below. FIG. 1 is a schematic view of the whole of an ion-trap mass analyzing apparatus. The apparatus has a ring electrode 6 and two end cap electrodes 7 and 8 faced each other so as to sandwich the electrode 6. A sample for mass numerical analysis injected into an inter-electrode space after passing through a sample introducing portion 2 from a sample source 1 is ionized by collision with an electron emitted from an ion-generating electron gun 5. A quadrupole electric field is generated in an inter-electrode space by a DC voltage U and a high-frequency voltage V cos Ωt supplied to the end cap electrodes 7 and 8 by a drive main high-frequency power supply 4. Ions confined in an inter-electrode space stably oscillate. Whether the trajectory of an ion having the mass-to-charge ratio m/Z is stable (the oscillation amplitude of the ion does not exceed a certain value and the ion oscillates in an inter-electrode space) or unstable (the oscillation amplitude of the ion increases and the ion is emitted from an inter-electrode space or collides with an electrode) is determined by the fact that the ion corresponds to which values a and q in the stable region or unstable region shown in FIG. 3. Values a and q of each ion is obtained from the expression (1).

A voltage applied to an electrode by the drive main high-frequency power supply 4 in accordance with the measurement range of the mass-to-charge ratio m/Z of ions for mass numerical analysis is determined by a control section 3 in accordance with the size of an ion trap or the frequency of a high-frequency voltage. In the case of this embodiment, only a high-frequency voltage is applied without applying a DC voltage as a drive main high-frequency voltage. In this case, in the stable region in FIG. 3, every ion corresponding to every (a, q) points on the straight line of a=0 is stably captured. As shown in expression (1), when the mass-to-charge ratio m/Z of an ion differs, the value of q also differs. Therefore, only the ions corresponding to the range of q ($0 \leqq q \leqq =0.908$) where the straight line of a=0 and the stable region intersect each other are stably captured in the ion trap. In this case, each ion species oscillates at a different frequency correspondingly to its mass-to-charge ratio m/Z. By using this point, a auxiliary AC electric field having a certain frequency with which only one ion species corresponding to the value q (resonance emission point) in a range of $0 \leqq q \leqq 0.908$ resonate is generated between quadrupole electrodes, and purposed ion species are resonated and emitted from the space between electrodes by passing through the center hole 12 or a detection hole 13. The ions passing through the detection hole 13 are detected by a detector 9 and processed in a data processing section 10. Particularly, when the size of an ion trap (inner radius of the ring electrode $r_0$) and the angular frequency $\Omega$ of the drive main high-frequency voltage $V \cos \Omega t$ are fixed, ion species to be mass-resonance-emitted (ions having the mass-to-charge ratio m/Z to be selected) are swept by sweeping the amplitude V of the drive main high-frequency voltage based on the expression (1). In this case, the control section 3 controls a series of mass separation processes—ionization of samples, sweep of high-frequency voltage amplitude (mass sweep), amplitude and application type of auxiliary AC voltage, adjustment and detection of timing, and data processing.

As described above, the auxiliary AC electric field capable of generating ions for mass separation in an inter-electrode space capable of resonating and emitting the ions is roughly divided into the following two types: a dipole auxiliary AC electric field and a quadrupole auxiliary AC electric field. The dipole auxiliary AC electric field is generated by applying AC voltages shifted each other by half phase (out-of-phase) to two end cap electrodes. The quadrupole auxiliary AC electric field is generated by respectively applying AC voltage having the same phase to two end cap electrodes or applying an auxiliary AC voltage to a ring electrode. As shown in FIG. 1, two types of auxiliary AC voltage power supplies such as a dipole auxiliary AC voltage power supply 11*a* and a quadrupole auxiliary AC voltage power supply 11*b* are used to apply a quadrupole auxiliary AC voltage to a ring electrode. A method for applying each auxiliary AC voltage is described below.

Figure 14:
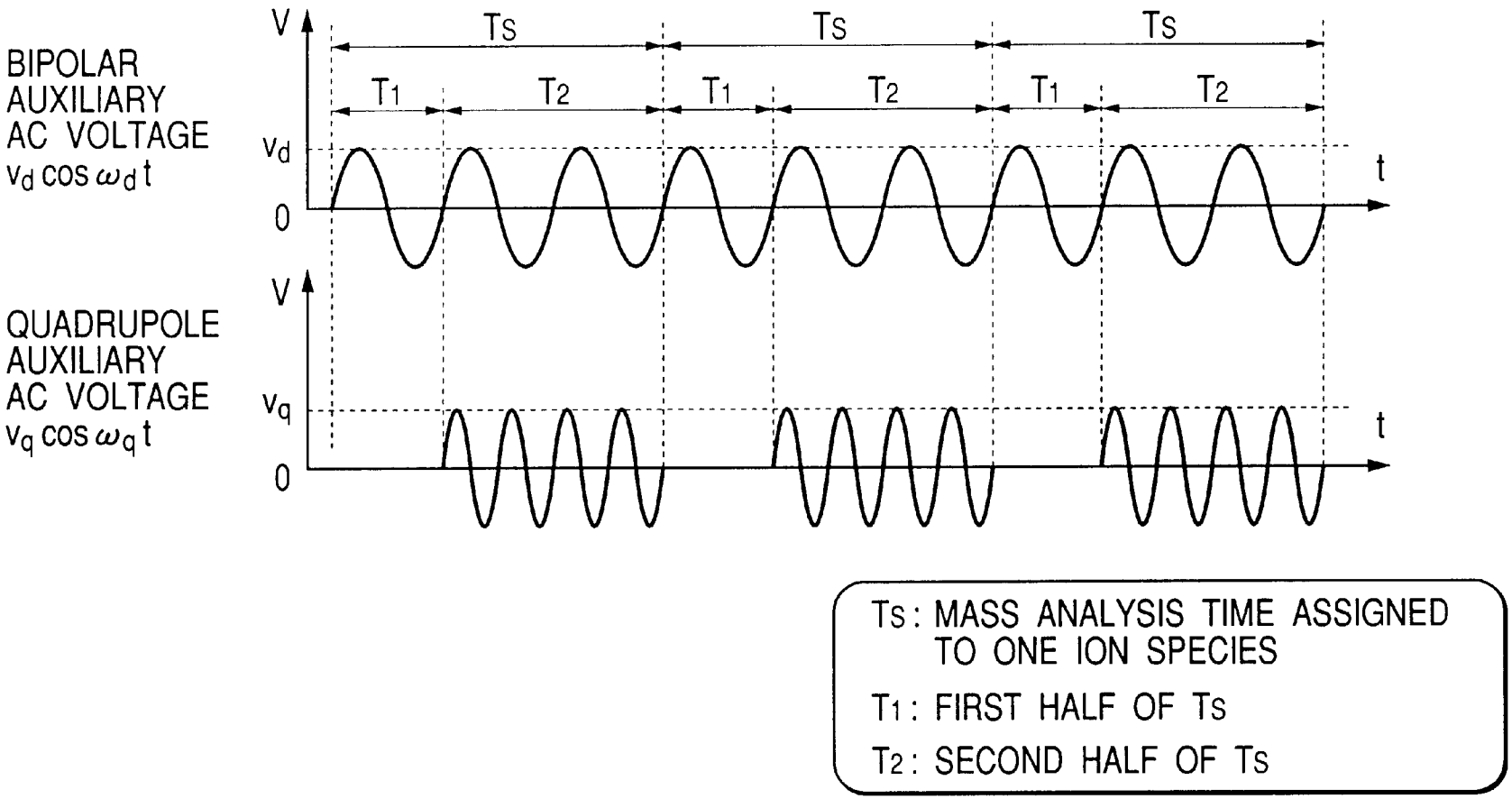
FIG. 14 is waveform diagrams of a dipole auxiliary AC voltage to be applied to an end cap electrode by shifting the voltage by part phase and a quadrupole auxiliary AC voltage to be applied to two end cap electrodes or a ring electrode when using the dipole and quadrupole auxiliary AC voltage applying method of embodiment 1 using a time difference.

For example, when a mass sweep rate S [mass/sec] is constant and a mass numerical analysis range is kept between $M_0$ [amu] and $M_1$ [amu], the time $T_s$ [sec] required for the entire mass sweep is shown by the expression $T_s=(M_1-M_0+1)/S$ and the time $t_s$ [sec] assigned to the mass numerical analysis of each one ion species is shown by the expression $t_s=1/S$. The time $T_s$ assigned to the mass numerical analysis of each ion species is divided into the first part $t_1$ and the second part $t_2$ as shown in FIG. 14. During the first part $t_1$, auxiliary AC voltages$+V_d \cos \omega d$ and $-V_d \cos \omega_d t$ shifted by part phase from each other are applied to two end cap electrodes by the dipole auxiliary AC voltage power supply 11*a*. Moreover, during the second part $t_2$, auxiliary AC voltages $V_q \cos qt$ having the same phase are applied to two end cap electrodes or an auxiliary AC voltage $V_q \cos \omega_q t$ is superimposed on a ring electrode by the quadrupole ax. AC voltage power supply 11*b*. In this case, the angular frequency $\omega_d$ of the dipole auxiliary AC voltage and the angular frequency $\omega_q$ of the dipole auxiliary AC voltage are set based on the relation of $\omega_q=2\times\omega_d$ effected between the angular frequencies $\omega_d$ and $\omega_q$.

Figure 15:
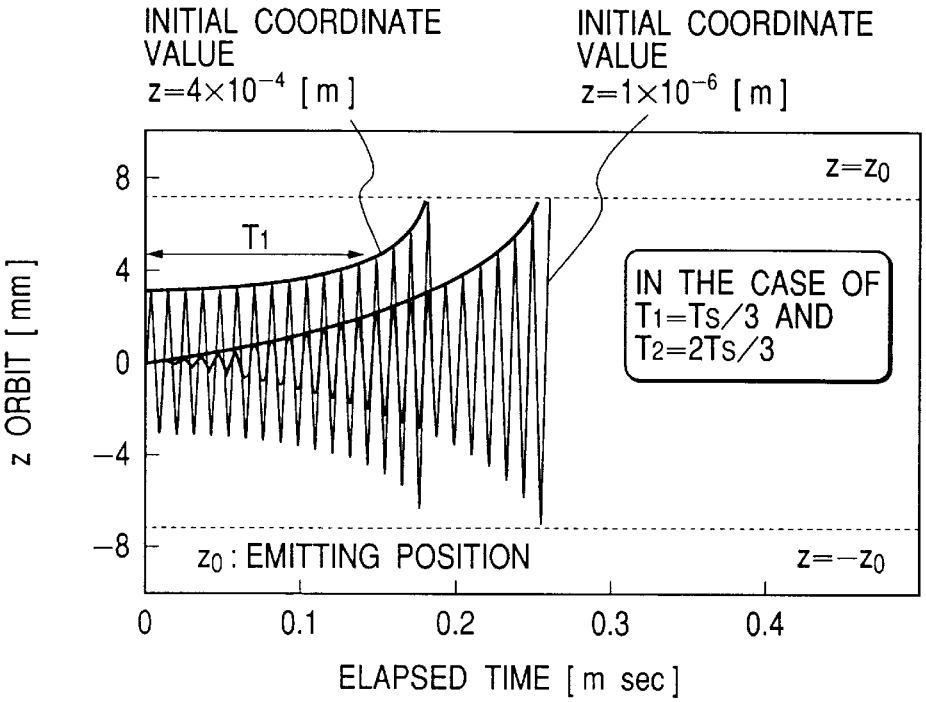
FIG. 15 is calculation results of two ion trajectories different from each other in initial coordinate value when using the dipole and quadrupole auxiliary AC voltage applying method of the first embodiment using a time difference.
Figure 16:
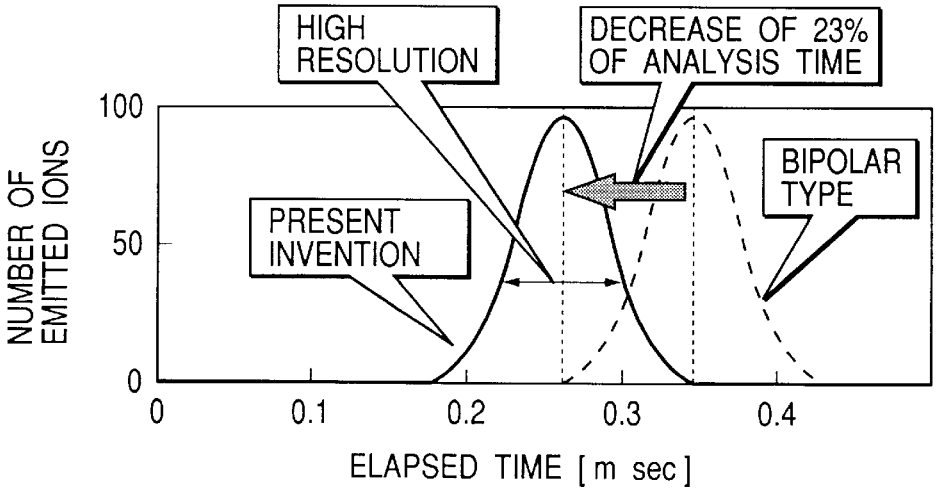
FIG. 16 is an calculation result of a mass spectrum when using the dipole and quadrupole auxiliary AC voltage applying method of the first embodiment of the present invention using a time difference.

FIG. 14 shows the waveform of each auxiliary AC voltage to be applied in this embodiment and FIGS. 15 and 16 show two ion trajectories different from each other in initial coordinate values and the then-obtained mass spectrum. These are numerical calculation results when setting the time distributions of the time $t_s$ assigned to the mass numerical analysis of each ion species divided into the first part $t_1$and the second part $t_2$ as $t_1=T_s/3$ and $t_2=(2T_s)/3$. From FIG. 15, it is found that because only a dipole auxiliary AC electric field is applied in the first part ti, an ion trajectory is almost linearly and slowly amplified with respect to time independently of the position coordinates of an ion. During this period, ions lose energy due to collision with the neutral gas present in the ion trap. Because the magnitude of the collision is proportional to the velocity of an ion motion, an ion having larger coordinate values, that is, larger amplitude has larger oscillation velocity, thereby receiving stronger resistance force. Therefore, it is found that there is an advantage of increasing the amplitude (position coordinates) of an ion oscillation while reducing the initial spatial dispersion. Among ions in the second part $t_2$, not only a dipole auxiliary AC electric field but also a quadrupole AC electric field are superimposed. The magnitude of the quadrupole auxiliary AC electric field is proportional to the position coordinates of an ion. From FIG. 15, it is found that because the initial spatial dispersion is reduced in the first part and the amplitude (position coordinates) of an ion increases, the resonant force due to the quadrupole auxiliary AC electric field increases and ion trajectories are rapidly amplified and ions are emitted without increasing the difference between position coordinates of ions (spatial spread). The then-obtained mass spectrum (FIG. 16) has a high resolution almost equal to the resolution obtained when applying only a dipole auxiliary AC electric field (FIG. 6) and, moreover, the ion emission time (corresponding to the peak position of the mass spectrum) is decreased by approx. 23%. That is, because the numerical analysis time of one ion species can be decreased, it is found that the entire mass sweep time can be also decreased.

Therefore, this embodiment makes it possible to accelerate a high-resolution numerical analysis and expect avoiding a mass shift (positional displacement of a mass spectrum), by further superimposing only a dipole auxiliary electric field effective to reduce the spatial spread in the first part of the numerical analysis time assigned to the mass numerical analysis of an ion having the mass-to-charge ratio m/Z to be detected, and a quadrupole auxiliary voltage capable of quickly emitting ions in the second part of the numerical analysis time when position coordinates are large.

Figure 20:
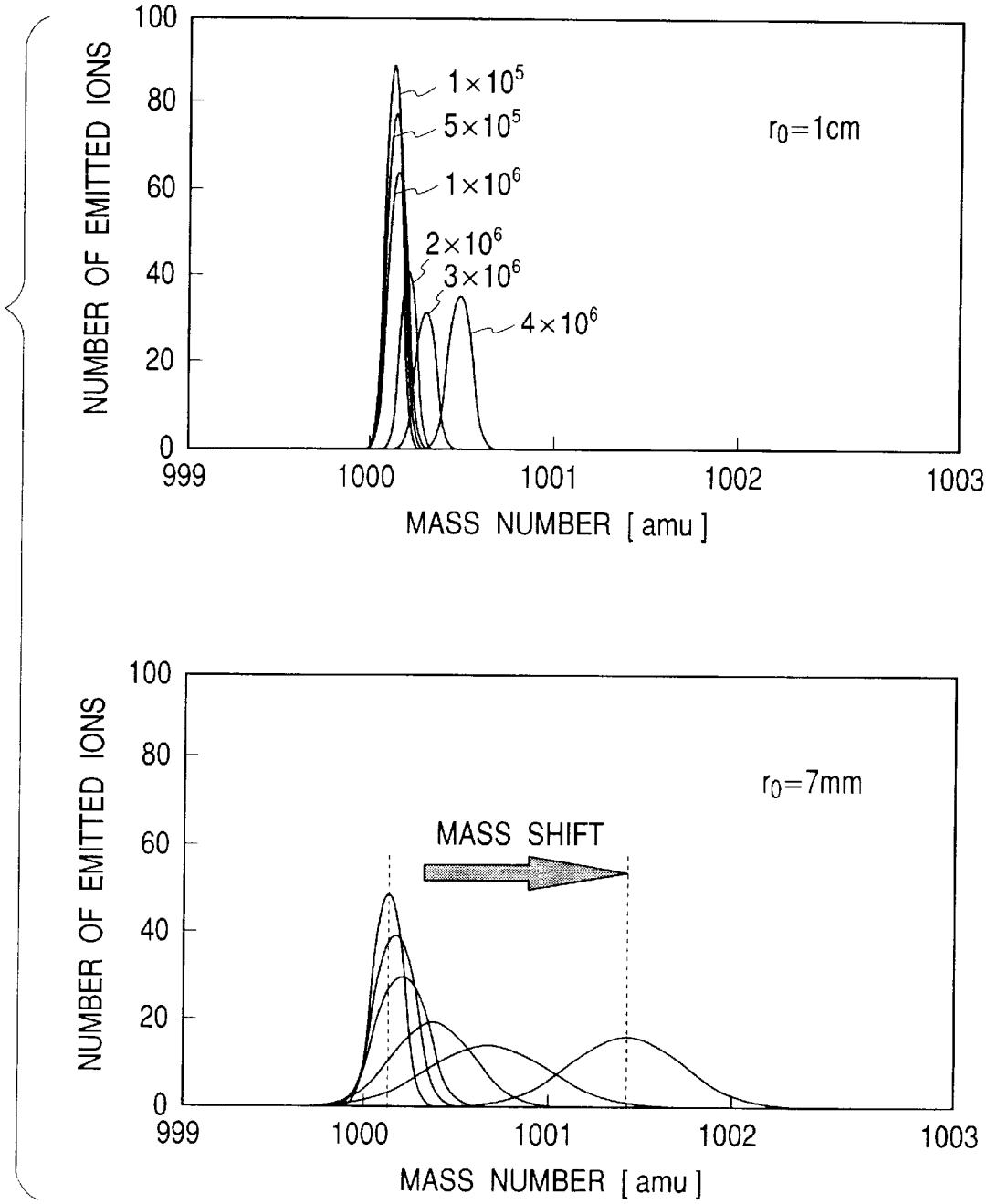
FIG. 20 shows numerical calculation results of a mass spectrum obtained when changing inner radius $r_0$ of ring-electrode $r_0$.
Figure 21:
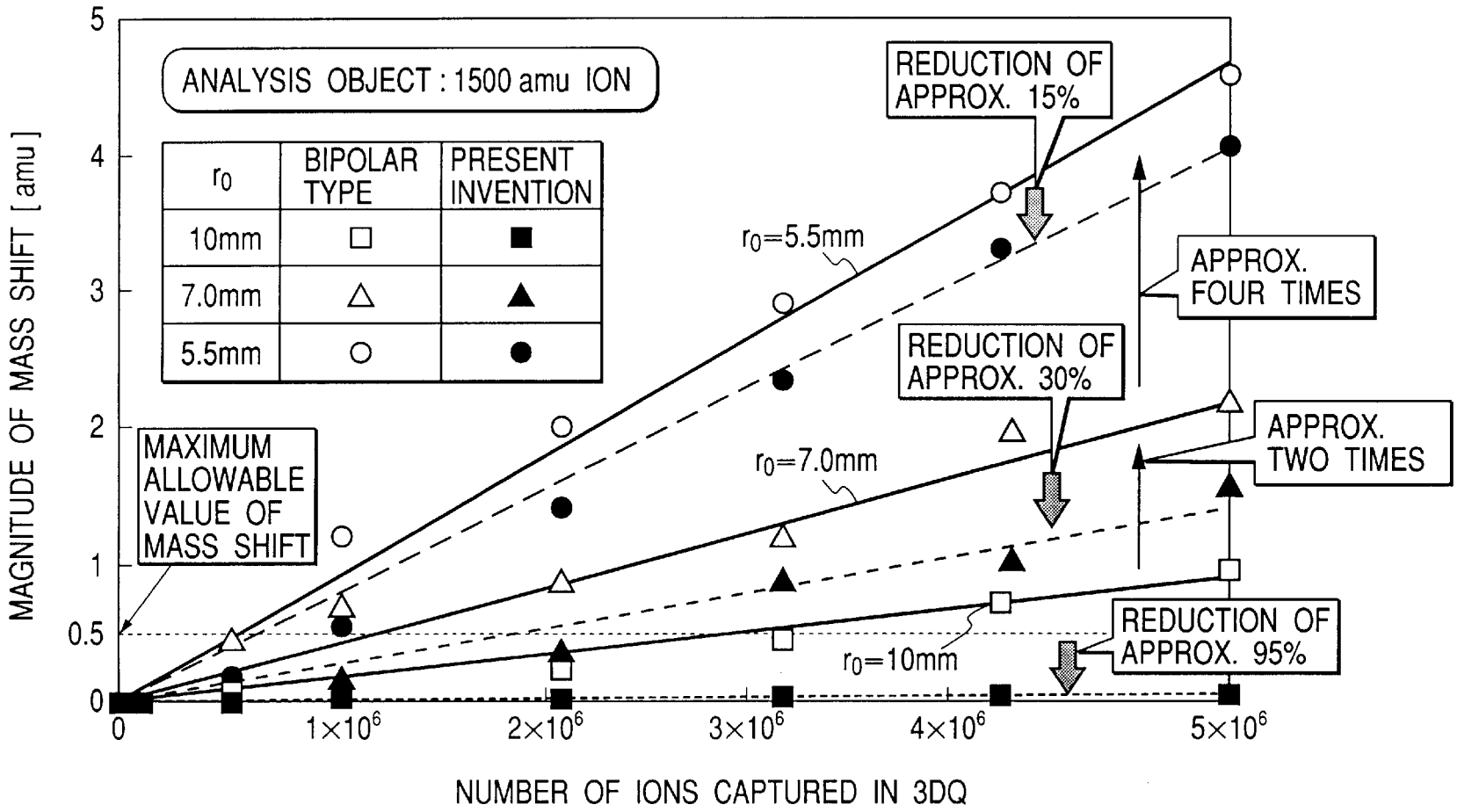
FIG. 21 is a numerical calculation result of the relation between the number of ions present in an ion trap and the degree of shifted mass spectrum (mass shift).

FIGS. 20 and 21 denote numerical results which show the mass-shift reduction effect when using this embodiment. FIG. 20 shows numerical calculations of a mass spectrum obtained when a ring electrode has inside radius $r_0$ of 1 cm and 7 cm. Enlargement of a mass numerical analysis range to the high mass number side is the recent needs for an ion-trap mass analyzing apparatus. The expression (1) provides reduction of an ion-trap electrode size (reduction of ring-electrode inside radius $r_0$) as one of the methods for enlargement of the mass numerical analysis range. In the case of this method, however, a mass shift may occur due to space charges (other ions) . From the results in FIG. 20, it is obviously found that a mass shift is larger in the case of a reduced size. A mass shift tend to occur due to more influences by space charges as the time when ions are confined in the space between ion-trap electrodes increases. Therefore, FIG. 21 shows comparison of calculated mass shifted degree between two cases: in one case, two type of auxiliary fields is employed as denoted in this embodiment; in the other case, only conventional dipole auxiliary AC field is applied. From FIG. 21, it is found that a mass shift degree decreases according to this embodiment in any case in which a ring electrode has an inside radius $r_0$ of 1 cm, 7 mm, or 5.5 mm. That is, it is confirmed that this embodiment has an advantage of reducing a mass shift degree (positional displacement of a mass spectrum).

Figure 17:
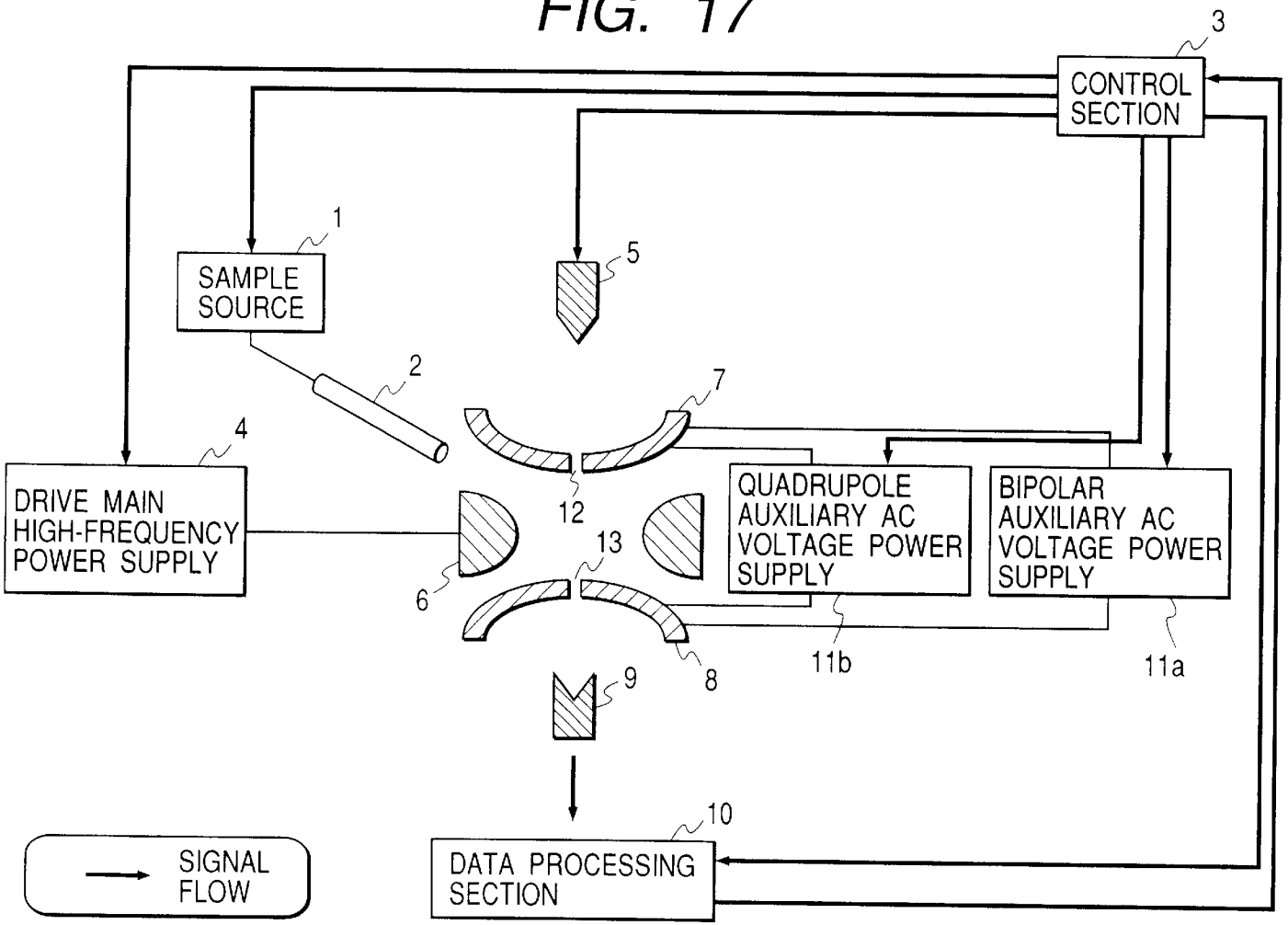
FIG. 17 is a schematic view of the whole of the ion-trap mass analyzing apparatus of the second embodiment.

Then, the second embodiment is described below by referring to FIG. 17. In this case, as shown in FIG. 17, two types of auxiliary AC voltage power supplies such as a dipole auxiliary AC voltage power supply 11*a* and a quadrupole auxiliary AC voltage power supply 11*b* are used, and quadrupole auxiliary AC voltages having the same phase are applied to two end caps similarly to the case of the first embodiment. Though this embodiment is different from the first embodiment in an electrode to which a quadrupole auxiliary AC voltage is applied, the auxiliary resonant electric fields generated in an inter-electrode space are the same. Therefore, it can be expected that results almost same as those of the first embodiment are also obtained from this embodiment.

Figure 18:
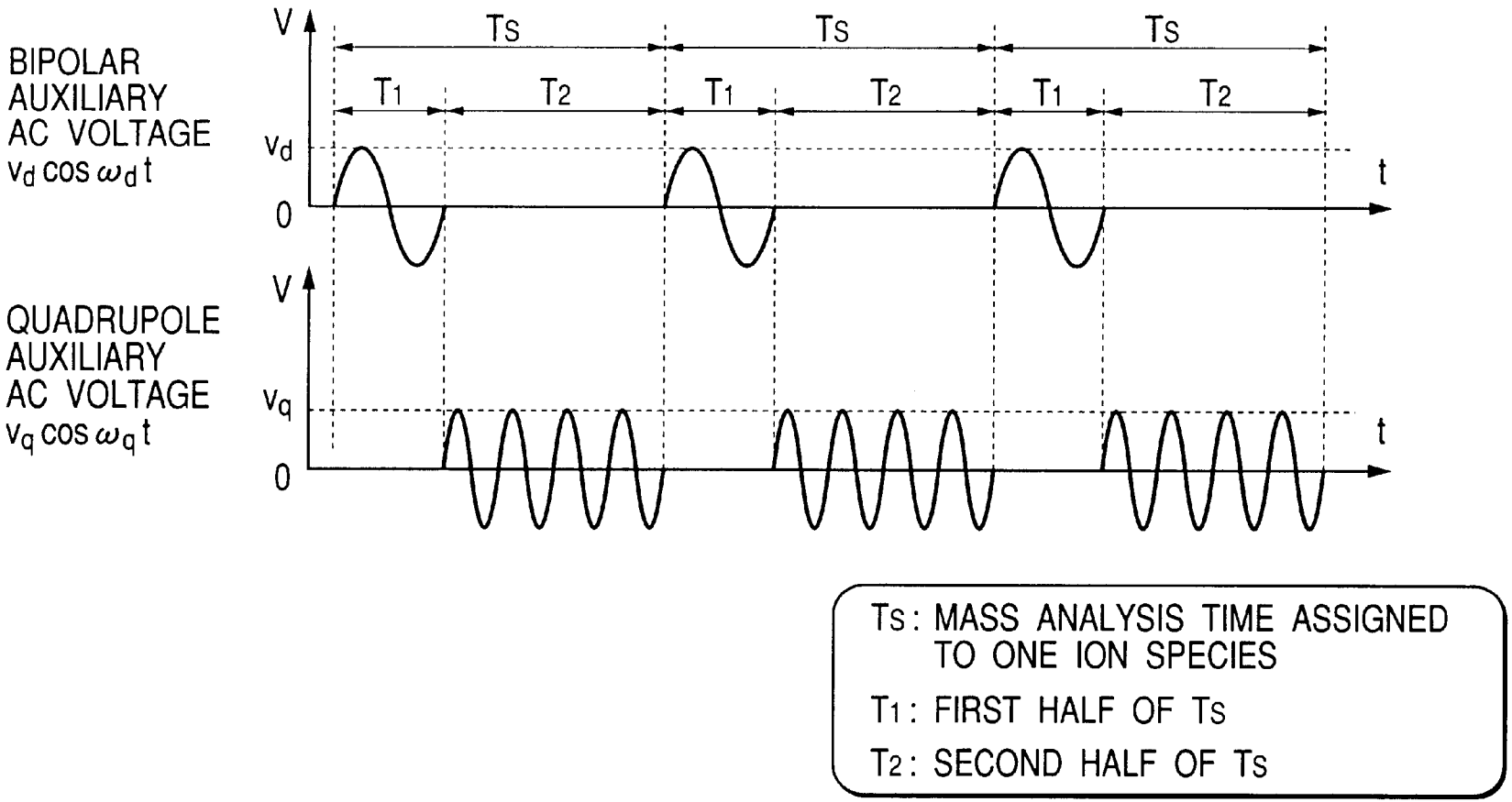
FIG. 18 is waveform diagrams of a dipole auxiliary AC voltage to be applied to an end cap electrode by shifting the voltage by part phase and a quadrupole auxiliary AC voltage to be applied to two end cap electrodes or a ring electrode when using the dipole and quadrupole auxiliary AC voltage applying method of the third embodiment using a time difference.

The third embodiment is described below by referring to FIG. 18. In this case, as shown in FIG. 18, only a dipole auxiliary electric field having an advantage of reducing a spatial spread is applied in the first part of the numerical analysis time assigned to the mass numerical analysis of an ion species having the mass-to-charge ratio m/Z to be detected, and only a quadrupole auxiliary voltage capable of rapidly emitting ions when position coordinates are large is applied in the second part of the numerical analysis time. It can be expected that results almost same as those of the first embodiment are also obtained from this embodiment.

Figure 19:
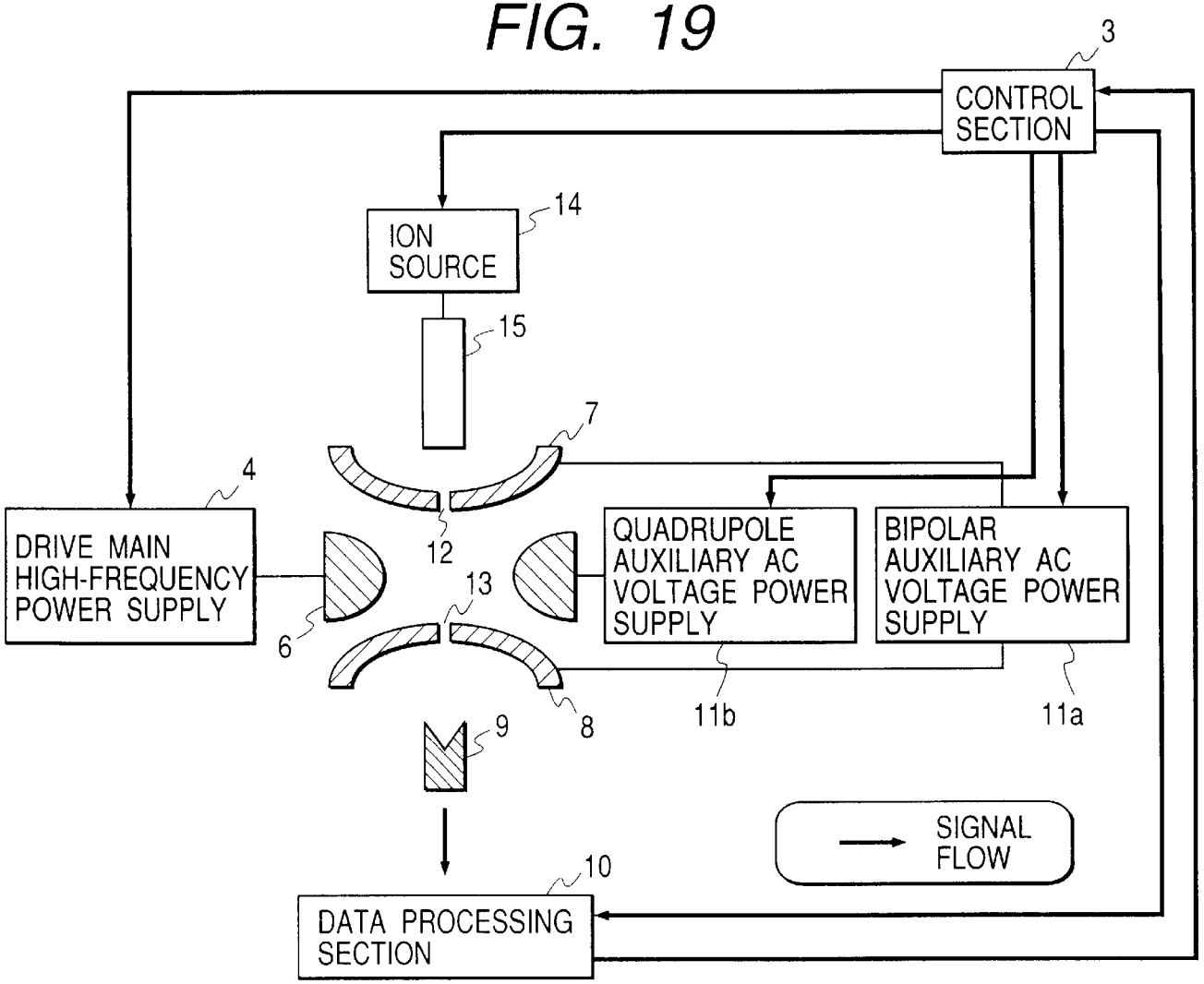
FIG. 19 is a schematic view of the whole of the ion trap mass analyzing apparatus of the fourth embodiment.

The fourth embodiment is described below by referring to FIG. 19. FIG. 19 is a schematic view of the whole of the ion-trap mass analyzing apparatus of the third embodiment. The first embodiment is an ion-trap mass analyzing apparatus for performing ionization between ion-trap electrodes combining with such as gas chromatography (GC) as a sample source. However, this embodiment sample ions are formed outside of an ion-trap mass analyzing apparatus by combining such as liquid chromatography as a sample source. Because the present invention relates to an auxiliary AC electric field applying method, it can be applied to any type of ionization. Therefore, advantages same as those of the above embodiments can be expected.

As described above, it is possible to provide an ion-trap mass analyzing apparatus (analyzing method) capable of improving the resolution while raising the scanning rate of a mass numerical analysis.

What is claimed is:

1. An ion-trap mass analyzing apparatus having a trap space which is enclosed by electrodes and in which ions are captured, and a controller for controlling an AC voltage to be applied to the electrode so as to form a first electric field and a second electric field for increasing the amplitude of oscillation of the captured ions; wherein the first electric field is an electric field having less influence of the amplitude of ions oscillation on the position of them than the second electric field and the controller controls the AC voltage so as to form the second electric field after forming the first electric field.

2. The ion-trap mass analyzing apparatus according to claim 1, wherein the mass-to-charge ratio m/Z of an ion for mass separation is swept in a predetermined range.

3. An ion-trap mass analyzing apparatus having a trap space which is enclosed by electrodes and in which ions are captured and a controller for controlling an AC voltage to be applied to the electrode so as to form a dipole auxiliary electric field and a quadrupole auxiliary electric field, wherein the controller controls the AC voltage so as to form the quadrupole auxiliary electric field after forming the dipole auxiliary electric field.

4. The ion-trap mass analyzing apparatus according to claim 3, wherein a dipole auxiliary electric field and a quadrupole auxiliary electric field are alternately applied by temporally alternating one kind of auxiliary electric field with the other until one ion species having the mass-to-charge ratio m/Z to be detected is emitted from an inter-electrode space since such ions resonate.

5. The ion-trap mass analyzing apparatus according to claim 3, wherein a dipole auxiliary electric field and a quadrupole auxiliary electric field are alternately applied by temporally shifting the electric fields from each other within the numerical analysis time assigned to the mass numerical analysis of an ion having the mass-to-charge ratio m/Z for detection of one type.

6. The ion-trap mass analyzing apparatus according to claim 3, wherein-only a dipole auxiliary AC electric field is generated between electrodes in the first part time of a predetermined time, and a quadrupole auxiliary electric field is superimposed in the second part time of the predetermined time.

7. The ion-trap mass analyzing apparatus according to claim 3, wherein only a dipole auxiliary AC electric field is generated between electrodes in the first part time of a predetermined time and only a quadrupole auxiliary electric field is generated in the second part time of the predetermined time.

8. An ion-trap mass analyzing apparatus having an annular ring electrode and two end cap electrodes facing each other so as to sandwich the ring electrode, wherein RF electric field is formed to trap ions between electrodes by applying RF voltage between the ring and the end-cap electrodes by power supply, and two types of auxiliary AC electric fields are also formed between electrodes; one of them is a dipole one which is formed by applying out-of-phase AC voltages between the two end-caps; the other is a quadrupole one which is formed by applying in-phase AC voltages between the two end-caps or to the ring electrode; being controlled so as to form such quadrupole auxiliary field after forming a dipole auxiliary field alternately.

9. An ion-trap mass analyzing apparatus having an annular ring electrode and two end cap electrodes facing each other so as to sandwich the ring electrode, wherein at least a high-frequency voltage of a DC voltage and the high-frequency voltage to select an ion species having a mass-to-charge ratio to be detected out of ions stably captured in a quadrupole electric field formed in an inter-electrode space by applying at least high-frequency voltage of a DC voltage and the high-frequency voltage between the ring electrode and the end cap electrodes from a main power supply by generating an auxiliary AC electric field weaker than the quadrupole electric field and thereby, amplifying the trajectories of the ions to be mass selected detected and emitting the ion from the inter-electrode space; wherein a dipole auxiliary electric field and a quadrupole auxiliary electric field are temporally alternately applied within a predetermined time to such two types of auxiliary AC electric fields as a dipole auxiliary AC electric field generated by applying AC voltages shifted from each other by half time phase to the two end cap electrodes and a quadrupole auxiliary AC electric field generated by applying AC voltages having the same phase to the two end cap electrodes or applying an auxiliary AC voltage to the ring electrode.

10. An ion-trap mass analyzing method comprising the steps of applying an AC voltage to an electrode to capture ions in a trap space and forming first and second auxiliary electric fields for supplying energy to the captured ions to increase the amplitude of their oscillation, wherein the first auxiliary electric field has less influence of the amplitude of an ion on the position of it than the second auxiliary electric field and the second electric field is formed after the first electric field is formed.

11. An ion-trap mass analyzing method comprising the steps of forming an ion-trap space by two end cap electrodes facing each other so as to sandwich an annular ring electrode, forming a dipole auxiliary AC electric field by applying AC voltages shifted from each other by half phase between the two end cap electrodes, controlling the spatial dispersion between ions having the same mass-to-charge ratio, and forming the dipole auxiliary AC electric field and thereafter forming a quadrupole auxiliary AC electric field.

12. An ion-trap mass analyzing method comprising the steps of applying an AC voltage to an electrode to capture ions in a trap space and forming first and second auxiliary electric fields for increasing the amplitude of the captured ions, wherein the first auxiliary electric field has less influence of the amplitude of an ion on the position of it than the second auxiliary electric field and the second auxiliary electric field is formed after the first auxiliary electric field is formed.

13. An ion-trap mass analyzing method comprising the steps of applying an AC voltage to an electrode to capture ions in a trap space and forming first and second auxiliary electric fields for increasing the amplitude of the captured ions, wherein the first auxiliary electric field has smaller spatial spread than the second auxiliary electric field and the second auxiliary electric field is formed after the first auxiliary electric field is formed.

* * * * *